US008092255B2

(12) United States Patent
Wang

(10) Patent No.: US 8,092,255 B2
(45) Date of Patent: Jan. 10, 2012

(54) BULB SET STRUCTURE

(75) Inventor: Sheng Lien Wang, Hsinchu County (TW)

(73) Assignee: Ting Shen Industrial Co., Ltd., Hsinchu (TW)

( * ) Notice: Subject to any disclaimer, the term of this patent is extended or adjusted under 35 U.S.C. 154(b) by 262 days.

(21) Appl. No.: 12/591,135

(22) Filed: Nov. 10, 2009

(65) Prior Publication Data

US 2011/0109242 A1 May 12, 2011

(51) Int. Cl.
*H01R 13/66* (2006.01)

(52) U.S. Cl. ..... 439/620.22; 439/620.3; 439/620.21; 439/374; 439/235; 439/236; 362/365; 362/545; 362/631

(58) Field of Classification Search ..... 439/43, 439/55, 56, 105, 124, 135, 182, 186, 201, 439/228, 235, 236, 374, 375, 377, 620.02, 439/620.06, 620.15, 620.21, 620.22, 620.31; 362/221, 240, 249.02, 249.06, 365, 545, 362/631, 632; 315/294, 241 S, 185 S, 185 R
See application file for complete search history.

(56) References Cited

U.S. PATENT DOCUMENTS

| | | | | |
|---|---|---|---|---|
| 4,274,698 | A * | 6/1981 | Ahroni | 439/620.3 |
| 4,345,223 | A * | 8/1982 | Chien-Chun | 335/6 |
| 4,768,979 | A * | 9/1988 | Wu | 439/620.31 |
| 4,904,976 | A * | 2/1990 | Liaq | 337/197 |
| 6,910,788 | B2 * | 6/2005 | Jones | 362/506 |
| 7,066,628 | B2 * | 6/2006 | Allen | 362/267 |
| 7,140,920 | B1 * | 11/2006 | Lin | 439/620.3 |
| 7,201,616 | B2 * | 4/2007 | Smith | 439/830 |
| 7,387,403 | B2 * | 6/2008 | Mighetto | 362/218 |
| 7,883,242 | B2 * | 2/2011 | Ng et al. | 362/249.06 |

* cited by examiner

*Primary Examiner* — Haiss Philogene
(74) *Attorney, Agent, or Firm* — Bacon & Thomas, PLLC

(57) ABSTRACT

A bulb set structure comprises a plug having two guiding pieces to connect with a power source and to assemble with a LED bulb set and a fitter, an orifice to output alternating current, and a power converting unit having one end to electrically connect with the guiding pieces, and having another end to connect with wires of the LED bulb set and the fitter by using the joining segment to convert the alternating current into direct current, and a circuit board is used to rectify the alternating current to output direct current to emit LED bulb set and to transmit the alternating current to the fitter.

8 Claims, 10 Drawing Sheets

BULB SET STRUCTURE

BACKGROUND OF THE INVENTION

1. Field of the Invention

The present invention relates to a bulb set structure that can stabilize voltage and rectify current.

2. Description of the Prior

Conventional bulb set structure disclosed in U.S. Pat. Nos. 4,768,979, 4,274,698, 4,345,223, 4,904,976, and 7,201,616 can not reduce rectification, and if alternating current is required, an extend power cord has to be used to cause an inconvenience.

In addition, a conventional bulb set is disclosed in U.S. Pat. No. 7,140,920 that includes a plug, one end of which is provided with two opposite guide pieces, and another end of which is connected to two wires, and includes a voltage stabilizer to convert alternating current into direct current, and the voltage stabilizer is electrically connected to the guide pieces and the wires. However, such a conventional bulb set will cause a short circuit on a rainy day.

The present invention has arisen to mitigate and/or obviate the afore-described disadvantages.

SUMMARY OF THE INVENTION

The primary object of the present invention is to provide a bulb set structure that is capable of converting alternating current into direct current to supply power to the LED bulb set.

Another object of the present invention is to provide a bulb set structure that is capable of assembling bulbs or connect to extended power cord.

A bulb set structure according to a preferred embodiment of the present invention comprises:

a plug, a power converting unit, a LED bulb set, and a fitter, wherein the plug includes two guiding pieces disposed on one end thereof and an orifice to output alternating current, and another end of the plug is connected with the LED bulb set and the fitter, and the plug includes a cavity and a plurality of chambers formed therein to receive the power converting unit;

the power converting unit at least includes a circuit board, an adaptor, two copper pieces, and a number of joining segments, the copper pieces are disposed on one end of the circuit board to electrically connect with the guiding pieces, the joining segment is mounted on another end of the circuit board and at least includes a first joining segment and two second joining segments, the adaptor is used to convert the alternating current into direct current, and the circuit board allows to convert the alternating current via the adaptor so that the direct current is outputted from the first joining segment, and the alternating current is outputted from the second joining segments, hence the circuit board and the adaptor are received in the cavity, and the first and the second joining segments are received in the chambers, the first joining segment is electrically connected with the LED bulb set, and the second joining segment is electrically connected with the fitter;

the LED bulb set includes a number of LED bulbs fitted together by using a first wire, and one end of the first wire is electrically connected with the first joining segment so that to pass the direct current to emit the LED bulbs;

the fitter includes a socket connected to a second wire, and a front end of the second wire is electrically connected with the second joining segment.

DETAILED DESCRIPTION OF THE PREFERRED EMBODIMENTS

Figure 1:
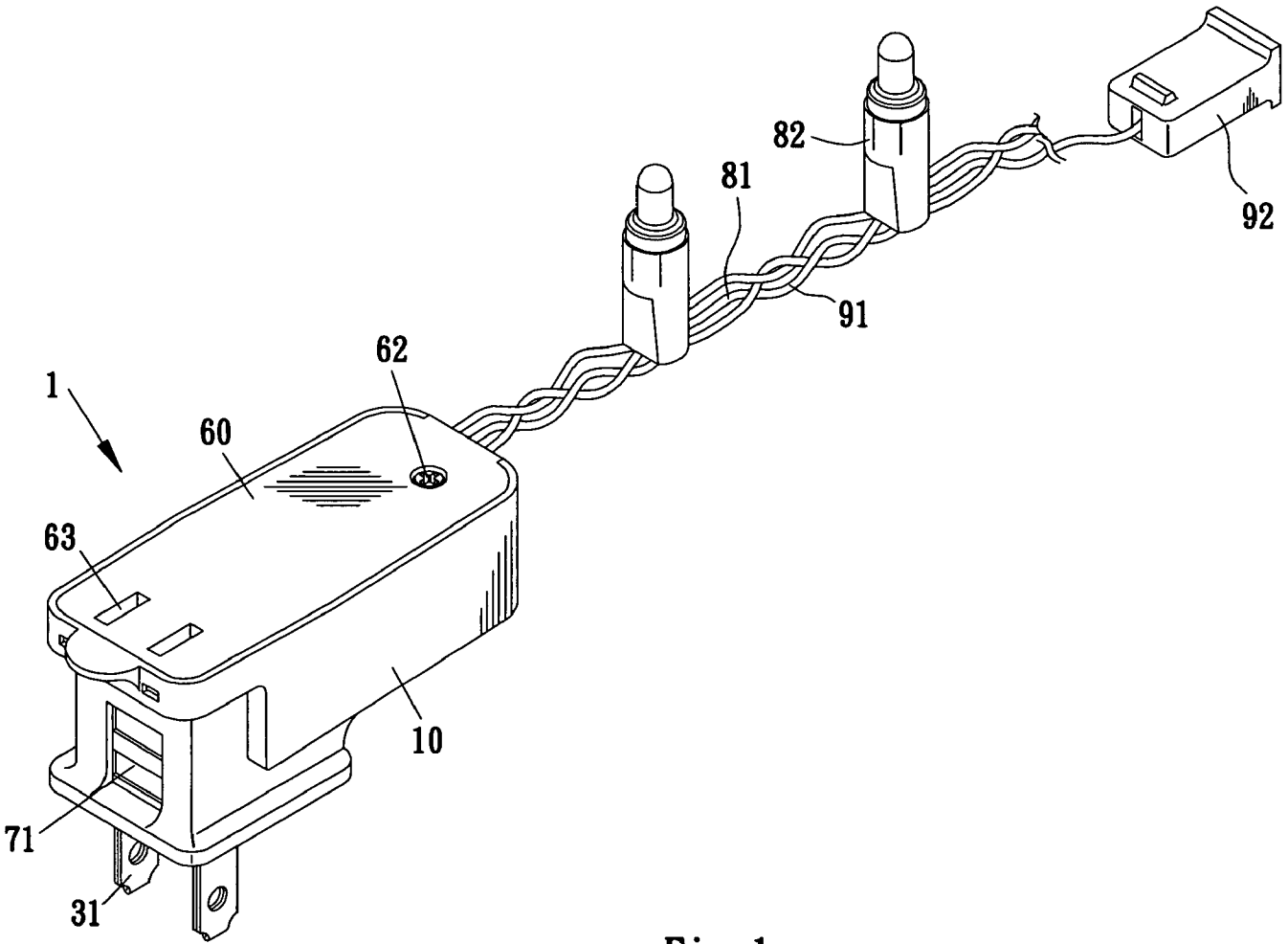
FIG. 1 is a perspective view showing the assembly of a bulb set structure according to a preferred embodiment of the present invention.
Figure 2:
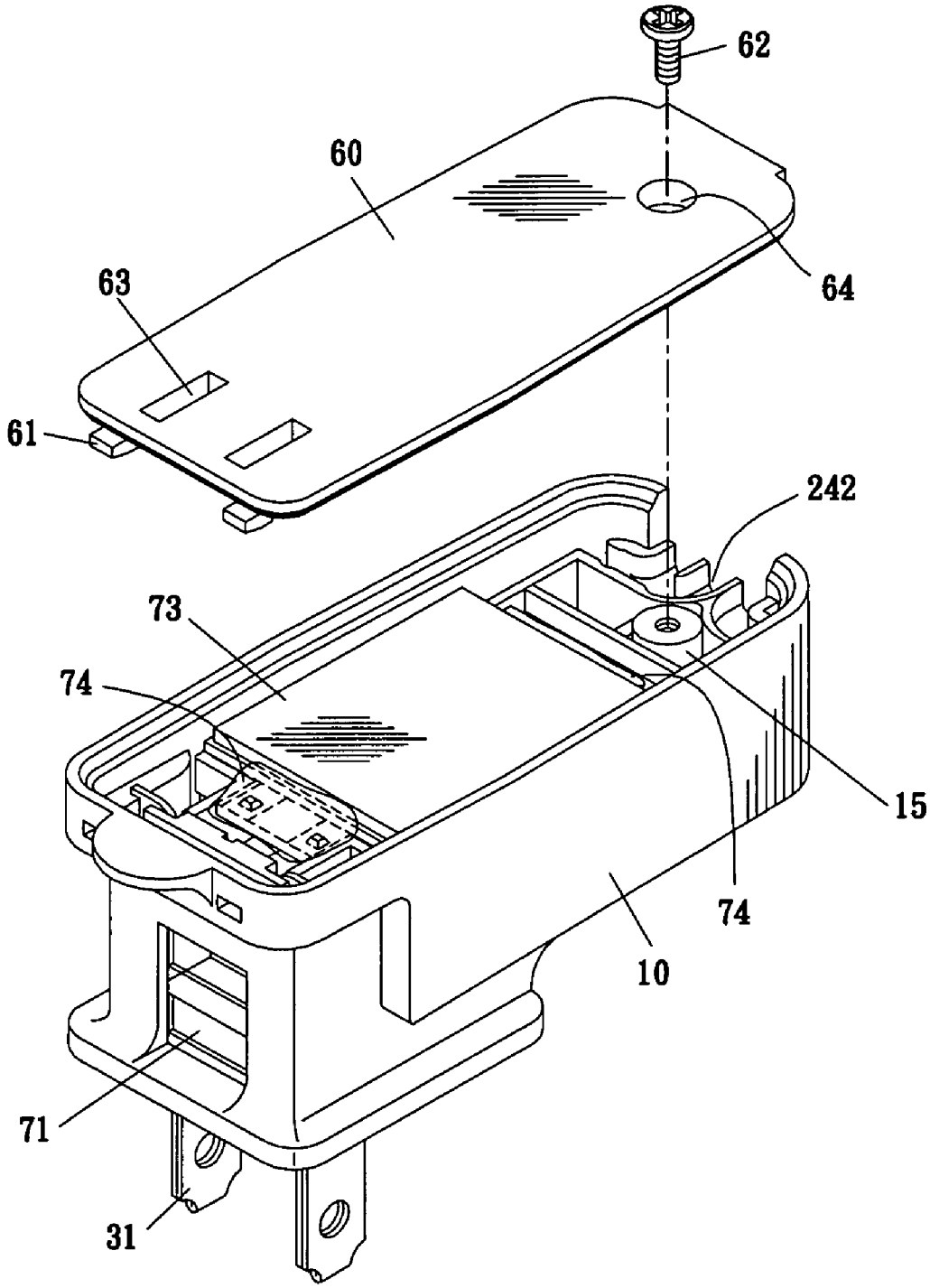
FIG. 2 is a perspective view showing the exploded components of the bulb set structure according to the preferred embodiment of the present invention.
Figure 3:
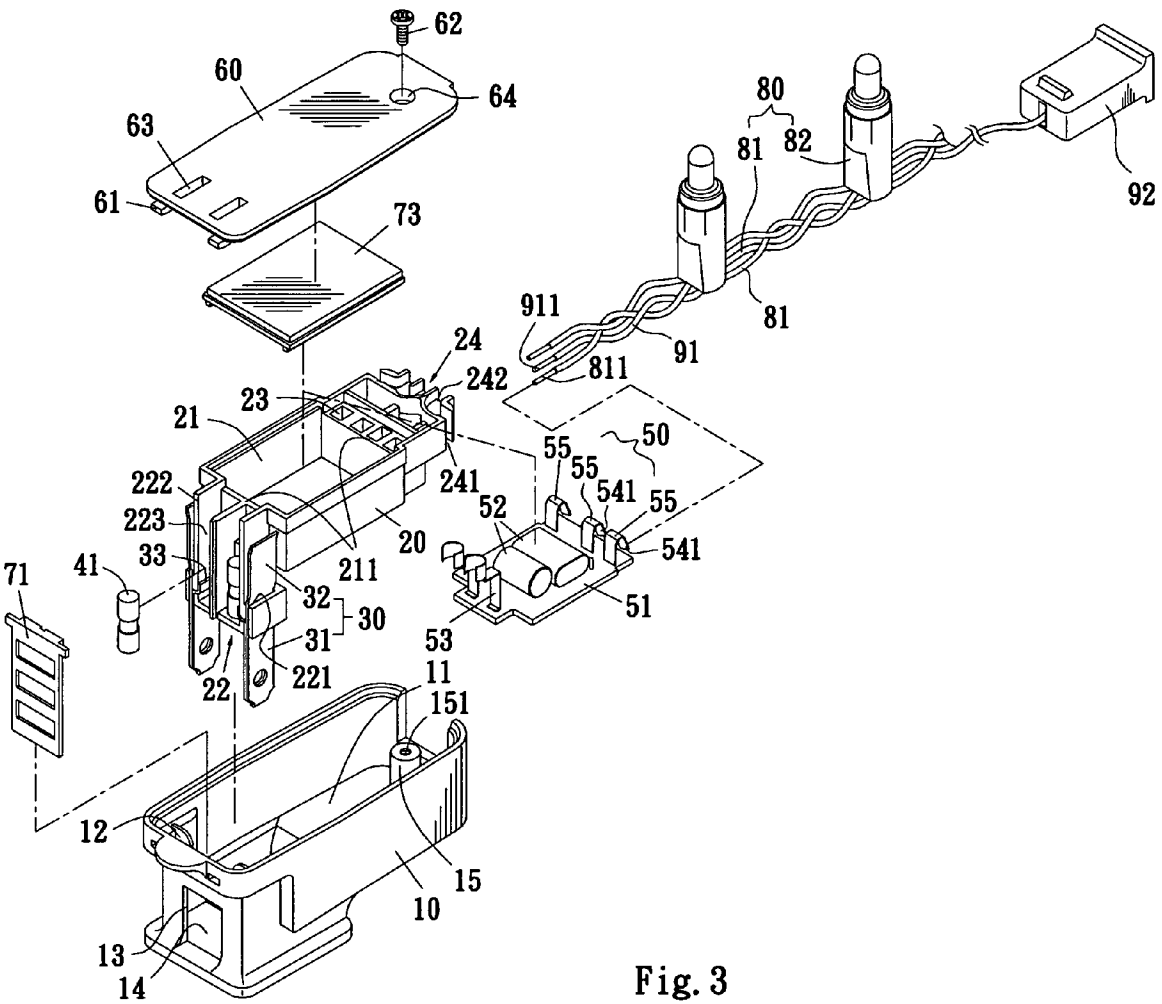
FIG. 3 is another perspective view showing the exploded components of the bulb set structure according to the preferred embodiment of the present invention.
Figure 4:
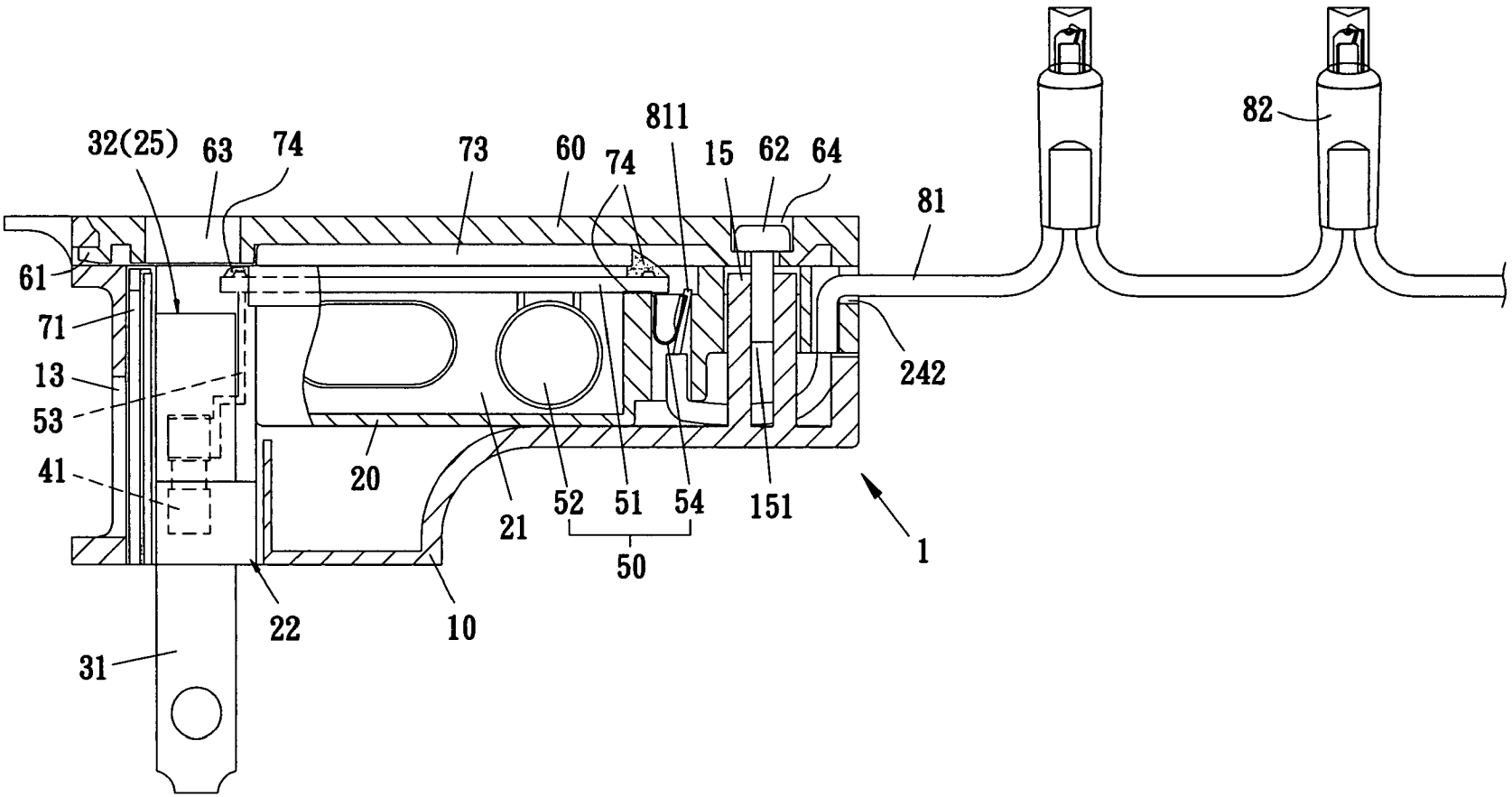
FIG. 4 is a cross sectional view showing the assembly of the bulb set structure according to the preferred embodiment of the present invention.

The present invention will be clearer from the following description when viewed together with the accompanying drawings, which show, for purpose of illustrations only, the preferred embodiment in accordance with the present invention.

Referring to FIGS. 1-7, a bulb set structure according to a preferred embodiment of the present invention comprises a housing 10 of a plug 1, an inserting member 20, two guide pieces 30, a number of fuses 41, a cover 60, and an internal lid 73, a power converting unit 50, a LED bulb set 80, and a fitter 90, wherein the housing 10 is formed in a rectangle shape, and includes a receiving portion 11 disposed on an inner rim thereof to receive the inserting member 20, and includes a sliding groove 12, a hole 13, and a bore 14 formed on one end thereof adjacent to the receiving portion 11, and the receiving portion 11 includes a column 15 with a screwing aperture 151 mounted on one side thereof. The sliding groove 12 is provided to fit a movable member 71 so that the movable member 71 moves along the sliding groove 12 to close or open the hole 13, and the bore 14 communicates with the receiving portion 11 to extend the guiding pieces 30 outward, and the guiding pieces 30 are fixed in the inserting member 20.

The inserting member 20 is formed in an inverted L shape, and includes a connecting portion 22 fixed on one side thereof to receive the guiding pieces 30 and the fuses 41, and includes a cavity 21, a plurality of chambers 23, and a coupling segment 24 disposed on another side thereof. Among the cavity 21, the connecting portion 22, and the chambers 23 are defined a plurality of spaces respectively. The connecting portion 22 includes a retaining recess 221, a plate member 222, and a slot 223 symmetrical to each other to join the guiding pieces 30 and the fuses 41. The cavity 21 and the chamber 23 are provided to receive electronic elements in response to the power converting unit 50, and the coupling segment 24 is comprised of a number of curved trenches 241 and limiting openings 242 to auxiliarily position the wires.

The guiding pieces 30 are disposed in the retaining recess 221 of the inserting member 20, and each guiding piece 30 includes an inserting section 31, a connect section 32, and an extending section 33. When the guiding pieces 30 are disposed in the retaining recess 221, the connect section 32 and the plate member 222 of the connecting portion 22 are spaced to form an orifice 25, and each extending section 33 is mounted on one side of the slot 223 to electrically connect with the fuse 41.

The power converting unit 50 is comprised of a circuit board 51, an adaptor 52 on the circuit board 51, two copper pieces 53, and a plurality of joining segments 54, 55. The circuit board 51 is a conventional PCB board, and includes one end in response to the connecting portion 22 to be welded with the copper pieces 53, and includes another end to be welded with the joining segments 54, 55. The joining segments 54, 55 at least includes a first joining segment 54 and two second joining ends 55 so that the circuit board 51 and the adaptor 52 are fixed in the cavity 21, and the first and the second joining segments 54, 55 are secured in the chambers 23. Besides, one ends of the cooper pieces 53 are electrically connected with the guiding piece 30 by fitting the fuses 41, the first joining segment 54 is electrically connected with the LED bulb set 80, and the second joining end 55 is electrically with the fitter 90.

Figure 5:
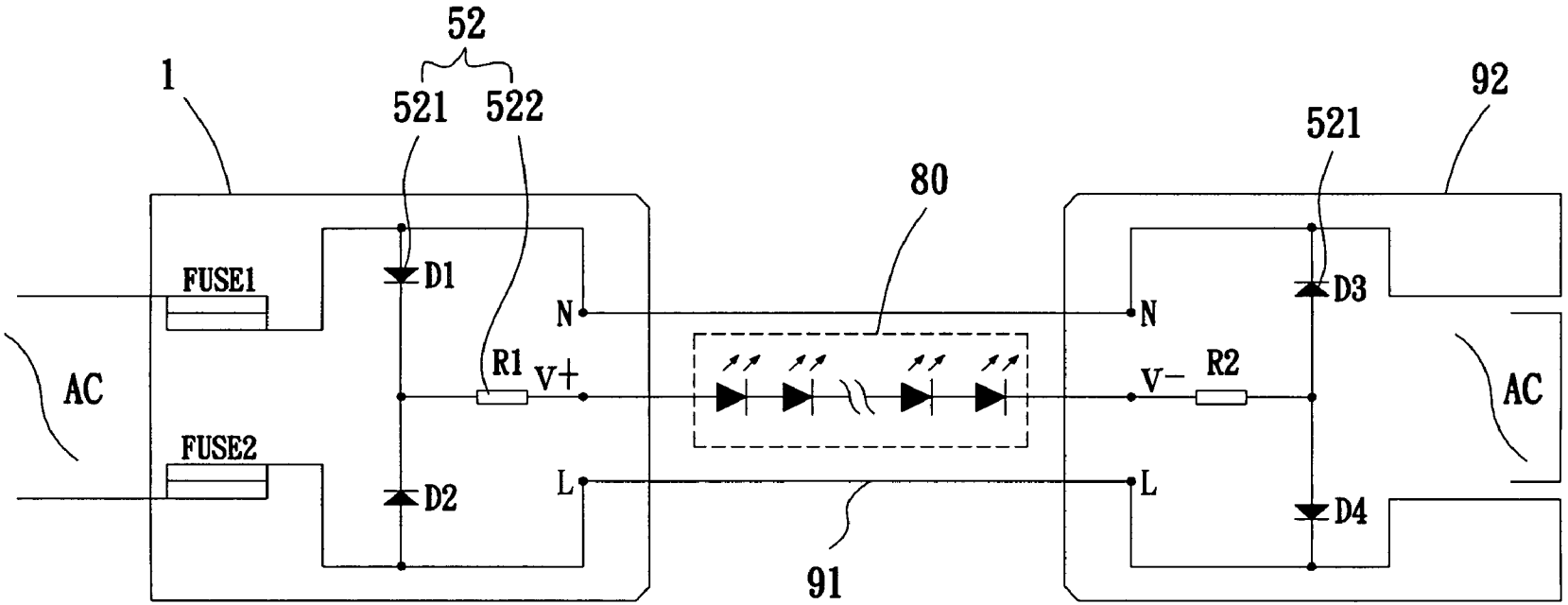
FIG. 5 is a circuit diagram a bulb set being used in full-wave rectification.
Figure 6:
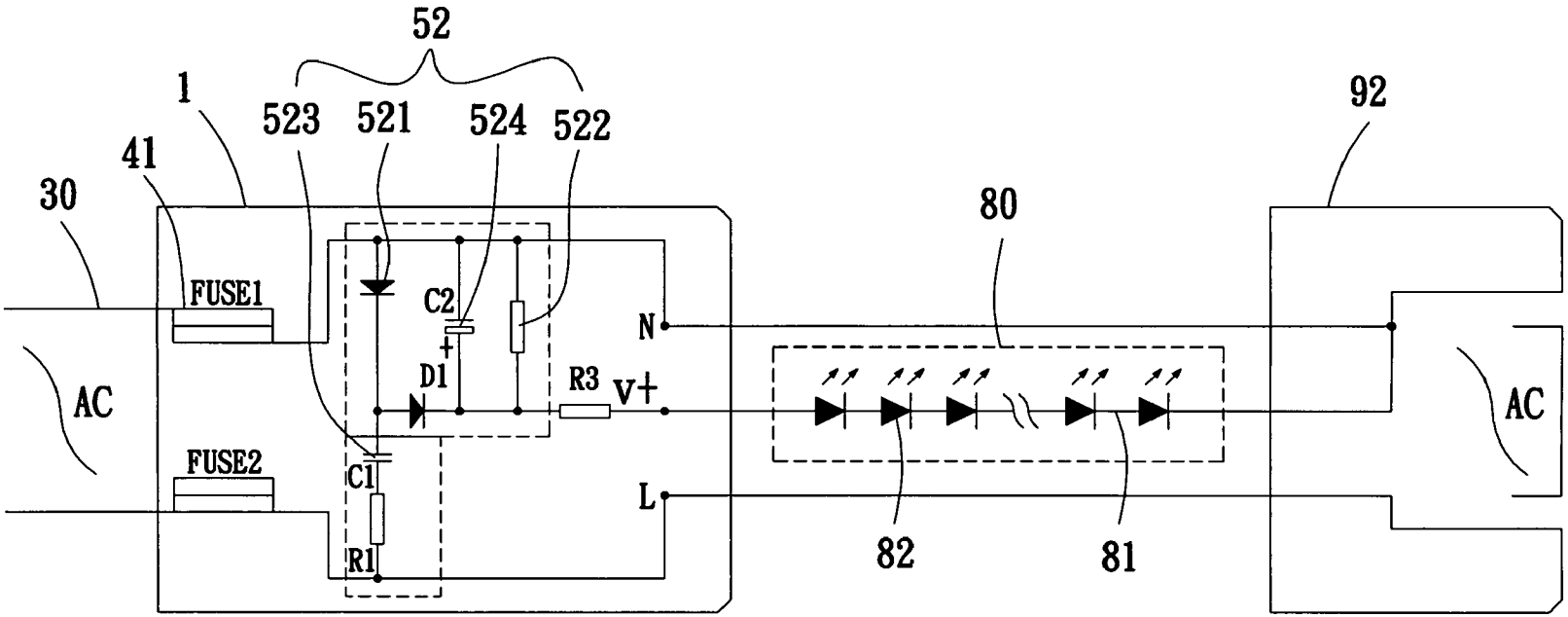
FIG. 6 is a circuit diagram a bulb set being used in semi-wave rectification.
Figure 7:
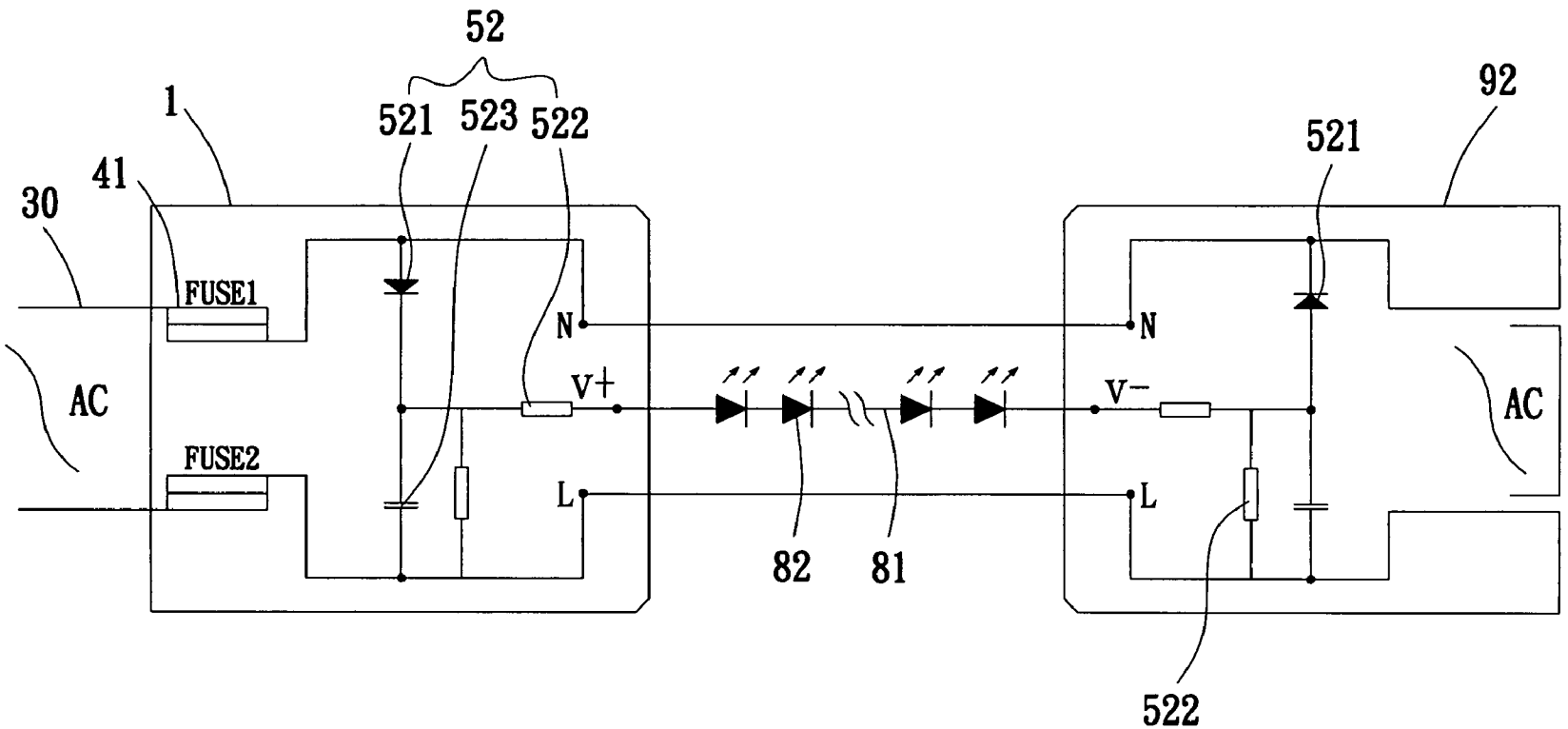
FIG. 7 is a circuit diagram a bulb set being used in bridge rectification.

With reference to FIGS. 5-7, the power converting unit 50 is used to reduce voltage and have rectification so that the adaptor 52 is disposed on the circuit board 51 of the plug 1, and two diodes 521 of the fitter 90 and a resistor 522 are assembled together to form a bridge rectification.

The adaptor 52 includes the diodes 521, the resistor 522, a metallized polyester film capacitor 523, and a filter capacitor 524 to match with other electronic elements to control safety, thus obtaining twice rectification.

Besides, the adaptor 52 also includes the diodes 521, the resistor 522, and the metallized polyester film capacitor 523 to match with other electronic elements to control safety, thus obtaining full-wave rectification.

Thereby, the adaptor 52 allows to reduce 100-240 volt of voltage to be used in bulb set safely, and an alternating current is converted into a direct current. After the alternating current is converted via the adaptor 52, the direct current is outputted from the first joining segment 54, and the second joining segment 55 is used to output the alternating current.

It is to be noted that the first and the second joining segments are made of metal materials and twisted to form a resilient member, one end of which is welded to the circuit board 51, and another end of which is provided with flexible members 541, 551 to electrically connect with the LED bulb set 80 and the fitter 90 individually.

When the related components of the power converting unit 50 are disposed on the inserting member 20, the internal lid 73 is covered to the circuit board 51, and a layer of waterproof glue 74 is applied to the two isolating sections 211, and two ends of the circuit board 51 which can not be covered by the internal lid 73 is also applied by the waterproof glue 74 to obtain waterproof function.

The cover 60 is disposed to the housing 10, and one end of the housing 10 is fixed by tabs 61, and another end of the housing 10 is screwed to a notch 64 by a screw 62. Thereafter, the cover 60 is locked to the column 15 of the housing 10 to cover the inserting member 20, and the orifice 25 includes a dent 63 arranged on an outer side thereof to insert the guiding piece of a plug 2 of another bulb set into the orifice 25, thereby assembling the bulb sets together.

The LED bulb set 80 includes a plurality of LED bulbs 82 assembled together by using a first wire 81, such that one end of the first wire 81 is electrically connected with the first joining segment 54 so as to pass the direct current, thus emitting LED bulbs. Furthermore, an outer rim of the first wire 81 includes a guide segment 811 liquification formed from solder metal fluid, therefore as connecting electricity, the guide segment 811 is inserted in the flexible member 541 of the first joining segment 54 so that the flexible member 541 abuts against the guide segment 811.

The fitter 90 includes a second wire 91 connected to a plug 92, and a front end of the second wire 91 is electrically connected with the second joining segment 55, and an outer rim of the second wire 91 is liquification formed from solder metal fluid to obtain a guide segment 911, therefore as connecting electricity, the guide segment 911 is inserted in the flexible member 551 of the second joining segment 55 so that the flexible member 551 abuts against the guide segment 911.

Figure 8:
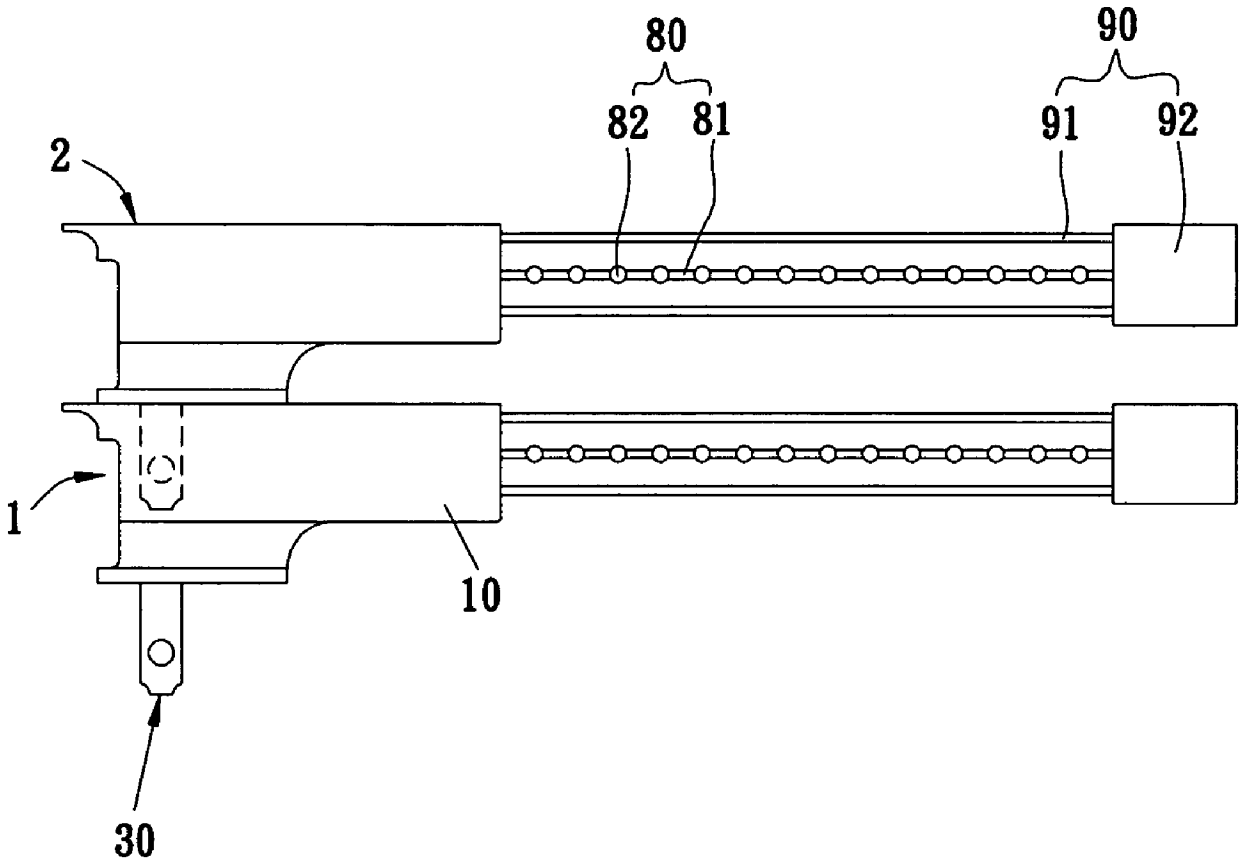
FIG. 8 is a plan view showing the operation of the bulb set structure according to the preferred embodiment of the present invention.
Figure 9:
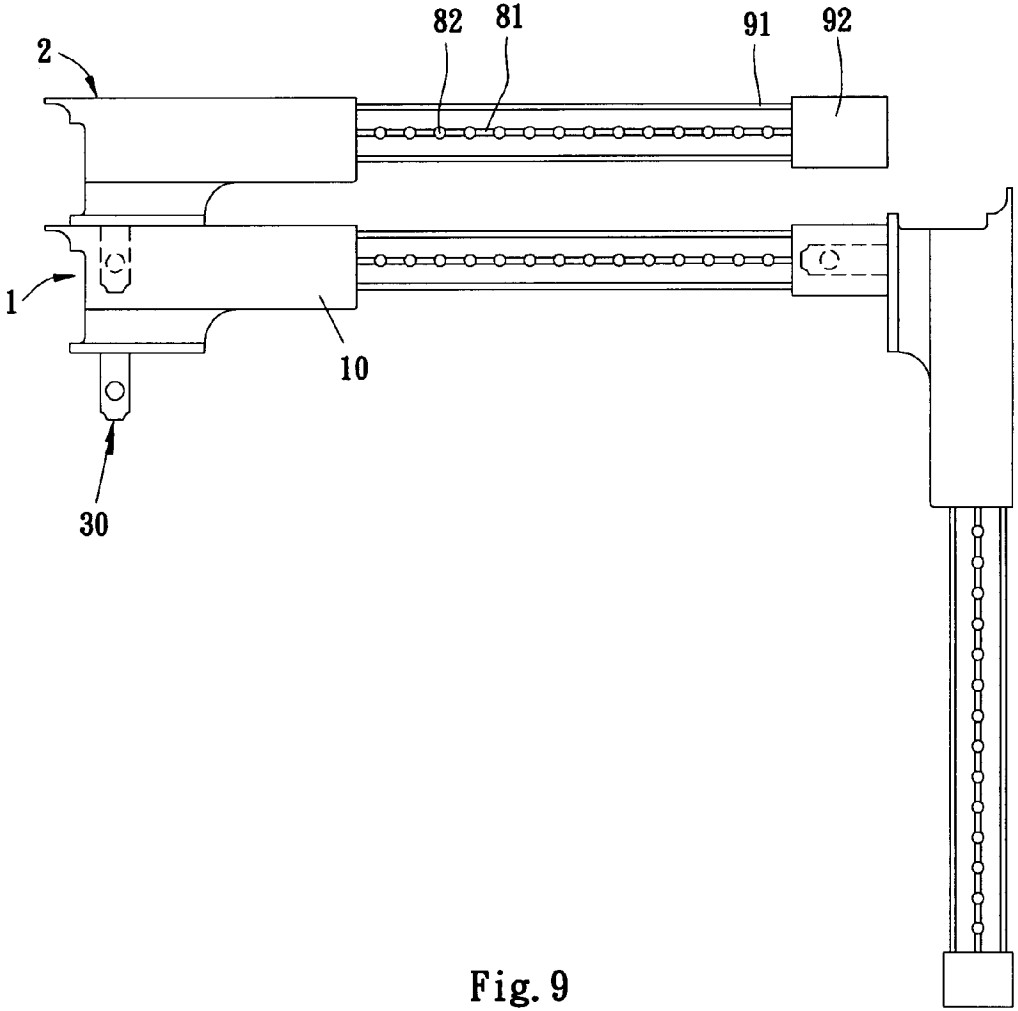
FIG. 9 is another plan view showing the operation of the bulb set structure according to the preferred embodiment of the present invention.
Figure 10:
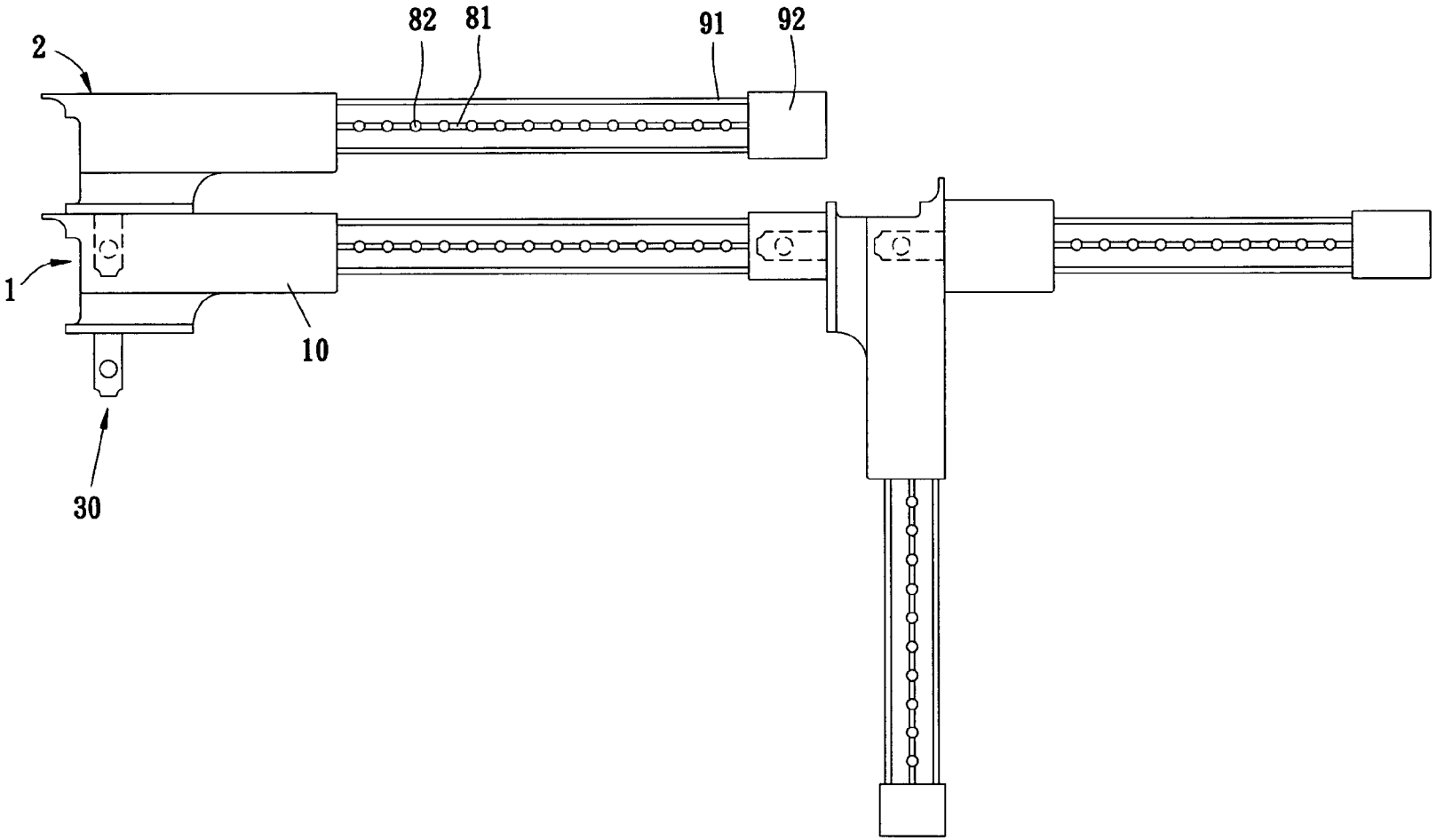
FIG. 10 is also another plan view showing the operation of the bulb set structure according to the preferred embodiment of the present invention.

Thereby, as the plug 1 is connected to a plug of the alternating current, the alternating current is converted into the direct current to supply power toward the LED bulb set 80, and the direct current is outputted from the orifice 25 and the fitter 90 to supply power toward another Christmas bulb set or an extended power cord. Referring to FIGS. 8-10, the plug 1 provides various power output options, satisfying different demands.

In addition, the circuit board 51 of the power converting unit 50, the adaptor 52, the copper piece 53, the first and the second joining segment 54, 55 are received in the cavity 21, the slot 223, and the chamber 23 individually, and the waterproof glue 74 is applied to the isolating sections 211 and two outer ends of the circuit board 51, having waterproof function. Also, as on a rainy day, the chamber 23 is used to isolate rains to prevent from a short circuit.

While we have shown and described various embodiments in accordance with the present invention, it is clear to those skilled in the art that further embodiments may be made without departing from the scope of the present invention.

What is claimed is:

1. A bulb set structure comprising:

a plug, a power converting unit, a LED bulb set, and a fitter, wherein the plug includes two guiding pieces disposed on one end thereof and an orifice to output alternating current, and another end of the plug is connected with the LED bulb set and the fitter, and the plug includes a cavity and a plurality of chambers formed therein to receive the power converting unit;

the power converting unit at least includes a circuit board, an adaptor, two copper pieces, and a number of joining segments, the copper pieces are disposed on one end of the circuit board to electrically connect with the guiding pieces, the joining segment is mounted on another end of the circuit board and at least includes a first joining segment and two second joining segments, the adaptor is used to convert the alternating current into direct current, and the circuit board allows to convert the alternating current via the adaptor so that the direct current is outputted from the first joining segment, and the alternating current is outputted from the second joining segments, hence the circuit board and the adaptor are received in the cavity, and the first and the second joining segments are received in the chambers, the first joining segment is electrically connected with the LED bulb set, and the second joining segment is electrically connected with the fitter;

the LED bulb set includes a number of LED bulbs fitted together by using a first wire, and one end of the first wire is electrically connected with the first joining segment so as to pass the direct current to emit the LED bulbs;

the fitter includes a socket connected to a second wire, and a front end of the second wire is electrically connected with the second joining segment.

2. The bulb set structure as claimed in claim 1, wherein between one end of the cavity adjacent to the guiding pieces and another end of the cavity adjacent to the chambers are defined two isolating sections respectively, on which is applied a layer of waterproof glue so that between the cavity and the chambers are formed a plurality of spaces to prevent water from permeating.

3. The bulb set structure as claimed in claim 1, wherein the first and the second joining segments are twisted to form a resilient member, one end of which is provided with flexible members, and an outer rim of the first wire includes a guide segment liquification formed from solder metal fluid, therefore as connecting electricity, the guide segment is inserted in the flexible member of the first joining segment so that the flexible member abuts against the guide segment.

4. The bulb set structure as claimed in claim 1, wherein the plug is comprised of an inserting member, the guiding pieces, an internal lid, a housing, and a cover, the inserting member includes a connecting portion disposed on one side thereof, the cavity, and the chambers formed therein, and each chamber includes a coupling segment formed on an outer side thereof, and the coupling segment includes the guiding pieces and two fuses assembled thereon, after the power converting unit is received in the cavity, the internal lid is covered to the cavity, and the first and the second wires are fixed in the coupling segment, the housing includes a receiving portion arranged therein, and the receiving portion includes a column with a screwing aperture disposed on one side thereof to receive the inserting member, and then the cover is locked by screws.

5. The bulb set structure as claimed in claim 4, wherein each guiding piece includes an inserting section, a connect section, and an extending section so that the guiding piece is fixed to the connecting portion, the inserting section extends outward to be inserted to the socket, and between the connect section and the connecting portions is spaced the orifice, and the extending section is electrically connected with the fuses, and the cover includes two dents in response to the orifice to insert another plug.

6. The bulb set structure as claimed in claim 1, wherein the power converting unit is used to reduce voltage and have rectification so that the adaptor is disposed on the circuit board of the plug, and two diodes of the fitter and a resistor are assembled together to form a bridge rectification.

7. The bulb set structure as claimed in claim 6, wherein the adaptor includes the diodes, the resistor, a metallized polyester film capacitor, and a filter capacitor to match with other electronic elements to control safety, thus obtaining twice rectification.

8. The bulb set structure as claimed in claim 6, wherein the adaptor includes the diodes, the resistor, and a metallized polyester film capacitor to match with other electronic elements to control safety, thus obtaining full-wave rectification.

* * * * *